US008841856B1

(12) United States Patent
Beasley

(10) Patent No.: US 8,841,856 B1
(45) Date of Patent: Sep. 23, 2014

(54) CAPACITIVE LADDER FEED FOR AC LED

(71) Applicant: Robertson Transformer Co., Blue Island, IL (US)

(72) Inventor: Denny D. Beasley, La Grange Park, IL (US)

(73) Assignee: Robertson Transformer Co., Blue Island, IL (US)

( * ) Notice: Subject to any disclaimer, the term of this patent is extended or adjusted under 35 U.S.C. 154(b) by 0 days.

(21) Appl. No.: 14/045,581

(22) Filed: Oct. 3, 2013

(51) Int. Cl.
*H05B 41/16* (2006.01)
*H05B 33/08* (2006.01)

(52) U.S. Cl.
CPC ..... *H05B 33/0806* (2013.01)
USPC ..... 315/253; 315/185 R; 315/250

(58) Field of Classification Search
CPC ..... H05B 33/0827; H05B 33/0818; H05B 37/02; H05B 33/0809; H05B 33/0815; H05B 33/0851
USPC ..... 315/185 R, 201, 192, 213, 216, 217, 315/250, 312; 345/102
See application file for complete search history.

(56) References Cited

U.S. PATENT DOCUMENTS

| | | | | |
|---|---|---|---|---|
| 6,791,275 | B2 | 9/2004 | Shackle | |
| 6,826,059 | B2 * | 11/2004 | Bockle et al. | 363/17 |
| 6,853,150 | B2 * | 2/2005 | Clauberg et al. | 315/185 R |
| 8,410,725 | B2 * | 4/2013 | Jacobs et al. | 315/312 |
| 2010/0244724 | A1 * | 9/2010 | Jacobs et al. | 315/253 |
| 2012/0119662 | A1 * | 5/2012 | Radermacher | 315/158 |
| 2012/0286683 | A1 * | 11/2012 | Radermacher | 315/201 |
| 2013/0009560 | A1 * | 1/2013 | Takeda et al. | 315/201 |
| 2013/0278152 | A1 * | 10/2013 | Zhang et al. | 315/185 R |

FOREIGN PATENT DOCUMENTS

| | | | |
|---|---|---|---|
| CN | 201386933 | Y | 1/2010 |
| CN | 201621516 | U | 11/2010 |
| CN | 101917814 | A | 12/2010 |

* cited by examiner

*Primary Examiner* — Vibol Tan
(74) *Attorney, Agent, or Firm* — Robertson Transformer Co.; Grant Rodolph

(57) ABSTRACT

A circuit serving as a light source, the circuit comprising a first group of light-emitting diodes (LEDs), a second group of LEDs connected in anti-parallel with the first group of LEDs, wherein each of the first group of LEDs and the second group of LEDs comprises at least one LED, and a capacitor connected in parallel with the first group of LEDs and the second group of LEDs.

18 Claims, 9 Drawing Sheets

CAPACITIVE LADDER FEED FOR AC LED

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Light-emitting diodes (LEDs) have been extensively used for general lighting because of their desirable features such as long life, high energy efficiency, and design flexibility. Most households are powered by alternating current (AC) voltage mains, and thus stacks of LEDs may be directly connected to an AC voltage outlet without any direct current (DC) conversion. To fit AC excitation, a pair of LEDs (or two groups of back-to-back LEDs) may be connected in an anti-parallel arrangement, in which the two LEDs in the pair are connected in parallel, but with their orientations or polarities reversed. LEDs may be paired this way to protect each other from reverse voltage. A series string or stack of such pairs can be connected to an AC voltage source, and the LEDs in each pair take turns emitting light, on alternate half-cycles of the voltage source.

As each LED has a threshold voltage under which no current may flow through the LED, in an AC cycle around the time the voltage source crosses a zero point, there may be two periods of off-time in which no current flows through a pair of anti-parallel LEDs. To maximize light output and increase energy efficiency, it is therefore desirable to minimize the off-time of LEDs during AC operation.

SUMMARY

In one embodiment, the disclosure includes a circuit serving as a light source, the circuit comprising a first group of light-emitting diodes (LEDs), a second group of LEDs connected in anti-parallel with the first group of LEDs, wherein each of the first group of LEDs and the second group of LEDs comprises at least one LED, and a capacitor connected in parallel with the first group of LEDs and the second group of LEDs.

In another embodiment, the disclosure includes a light source comprising an LED array comprising a pair of anti-parallel connected LEDs, and a capacitor connected in parallel with the pair of LEDs and configured to reduce an off-time of the pair of LEDs.

In yet another embodiment, the disclosure includes a method for controlling an LED-based light source that operates under an alternating current (AC) power source and comprises at least one pair of anti-parallel connected LEDs, the method comprising producing an AC voltage across a pair of LEDs to substantially be a square wave, and exciting the pair of LEDs using the AC voltage.

In yet another embodiment, the disclosure includes a light source consisting essentially of a first string of LEDs, a second string of LEDs connected in anti-parallel with the first string of LEDs, one or more capacitors connected in parallel with the first string of LEDs and the second string of LEDs, an optional inductor connected in series with the first string of LEDs and the second string of LEDs, an optional capacitor connected in series with the inductor, the first string of LEDs, and the second string of LEDs, and a package that encompasses at least the first string of LEDs and the second string of LEDs.

In yet another embodiment, the disclosure includes a light source comprising a LED array comprising a first LED and a second LED connected in anti-parallel with the first LED, wherein the first LED and the second LED are configured to operate under an AC voltage, wherein a cycle of the AC voltage comprises a first half-cycle and a second half-cycle, wherein the first LED is configured to emit a first-colored light in the first half-cycle, wherein the second LED is configured to emit a second-colored light in the second half-cycle.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 1:
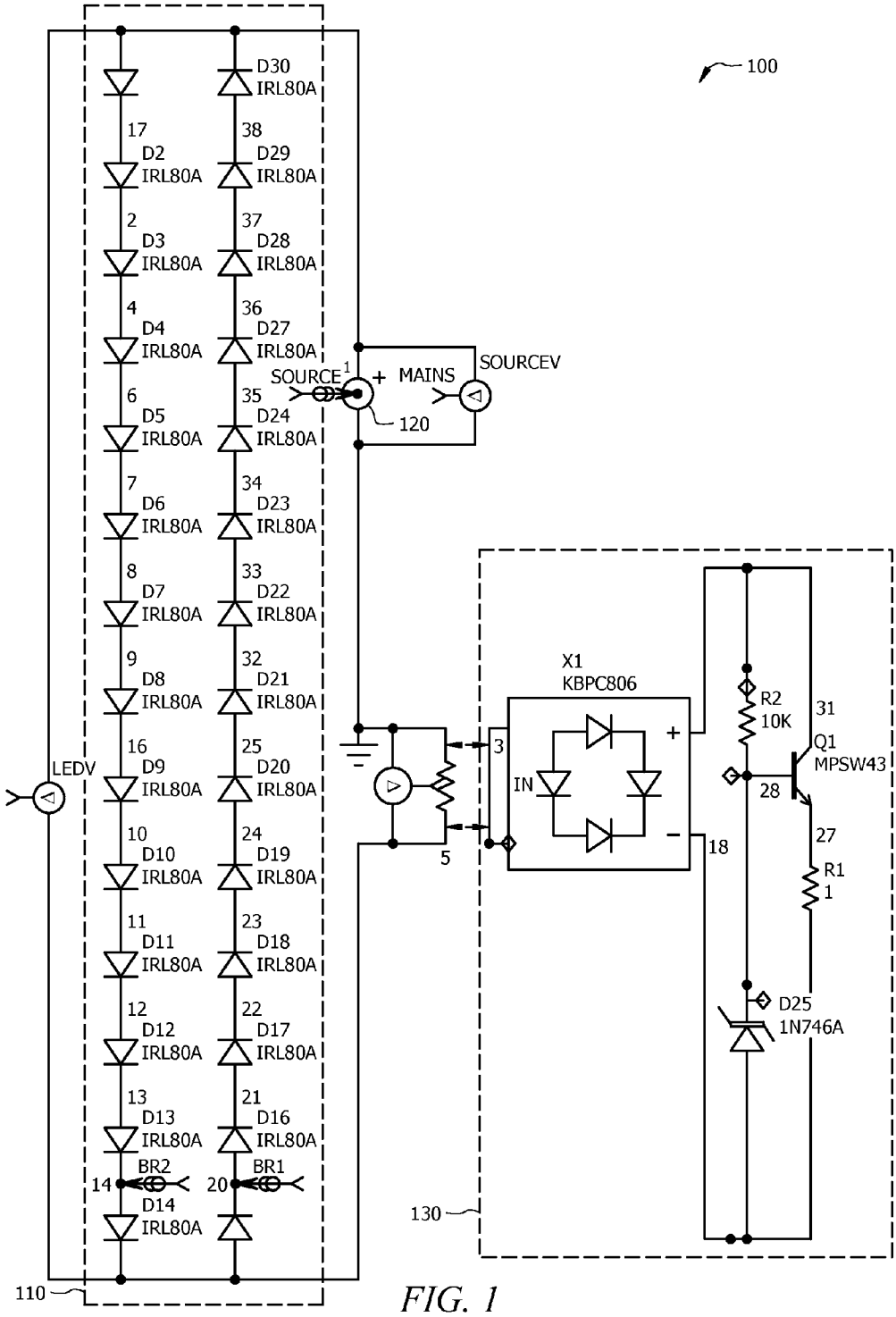
FIG. 1 is a schematic diagram of a conventional alternating current (AC) circuit.

FIG. 1 is a schematic diagram of a conventional circuit 100, which comprises a light-emitting diode (LED) array 110 connected to an alternating current (AC) voltage source 120. The conventional circuit 100 drives the LED array 110 directly with the AC voltage source 120. As shown in FIG. 1, the LED array 110 comprises two series connected strings of LEDs, with each string connected in reverse polarity to the other. In a conventional approach, some form of current/voltage control or regulation may need to be implemented by passive components (e.g., resistor) or active components (e.g., constant current regulator (CCR), integrated circuits (IC), or driver. In use, a voltage (at its peak) across the LED array 110 exceeding a sum of the compliance voltages for the LEDs in a string may cause the LED array 110 to be short circuited. For example, as shown in FIG. 1, a CCR equivalent circuit 130 may be connected in series with the LED array 110 to regulate an overall current flowing through the LED array 110.

Figure 2A:
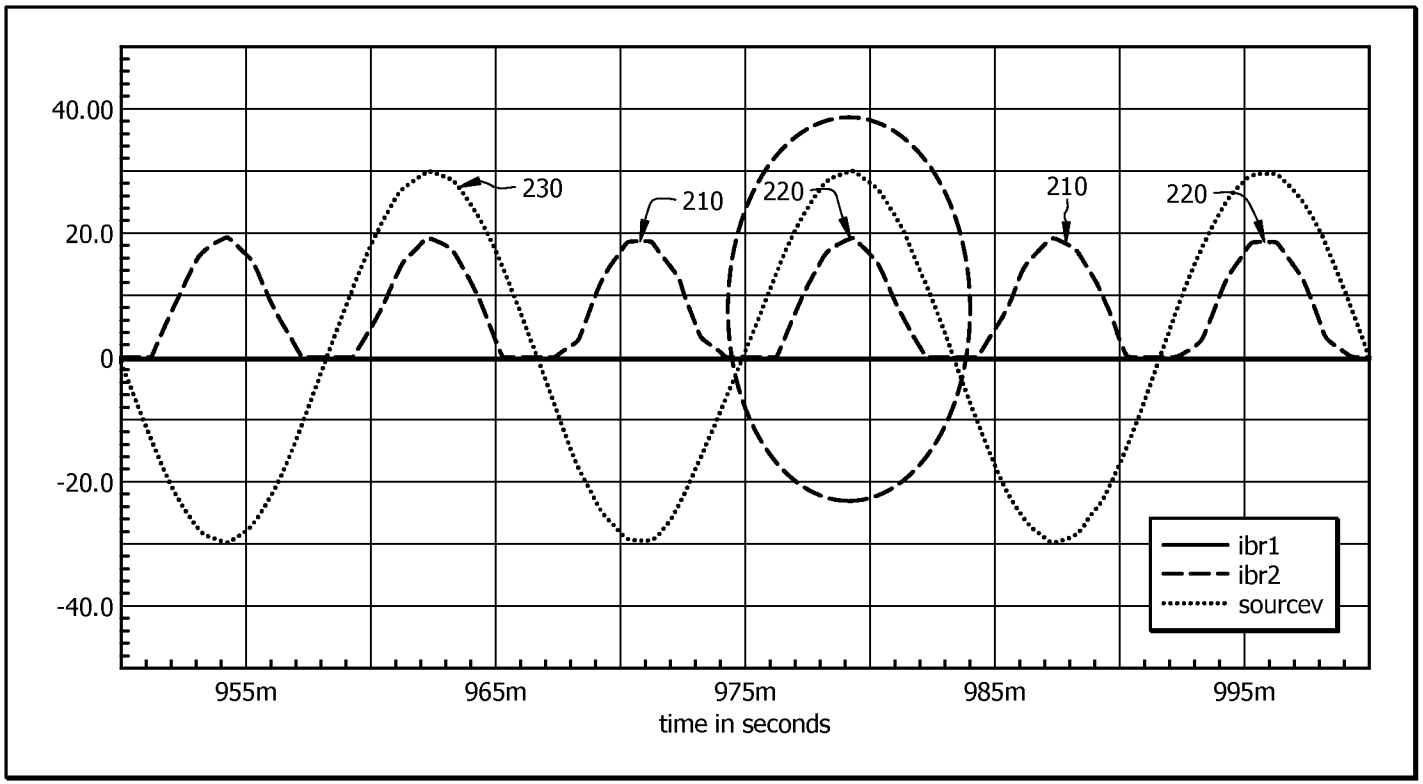
FIG. 2A is a chart of measured results of current and voltage waveforms in the conventional AC circuit.

FIG. 2A is a chart of measured results of current and voltage waveforms in the conventional circuit 100. Specifically, a waveform 210 (measuring point denoted as BR1 in FIG. 1) indicates a current flowing through one anti-parallel branch, another waveform 220 (measuring point denoted as BR2 in FIG. 1) indicates a current flowing through another anti-parallel branch, and yet another waveform 230 (measuring point denoted as SOURCEV in FIG. 1) indicates a voltage of the AC source. It can be seen that each anti-parallel branch may conduct half of the AC cycle.

Figure 2B:
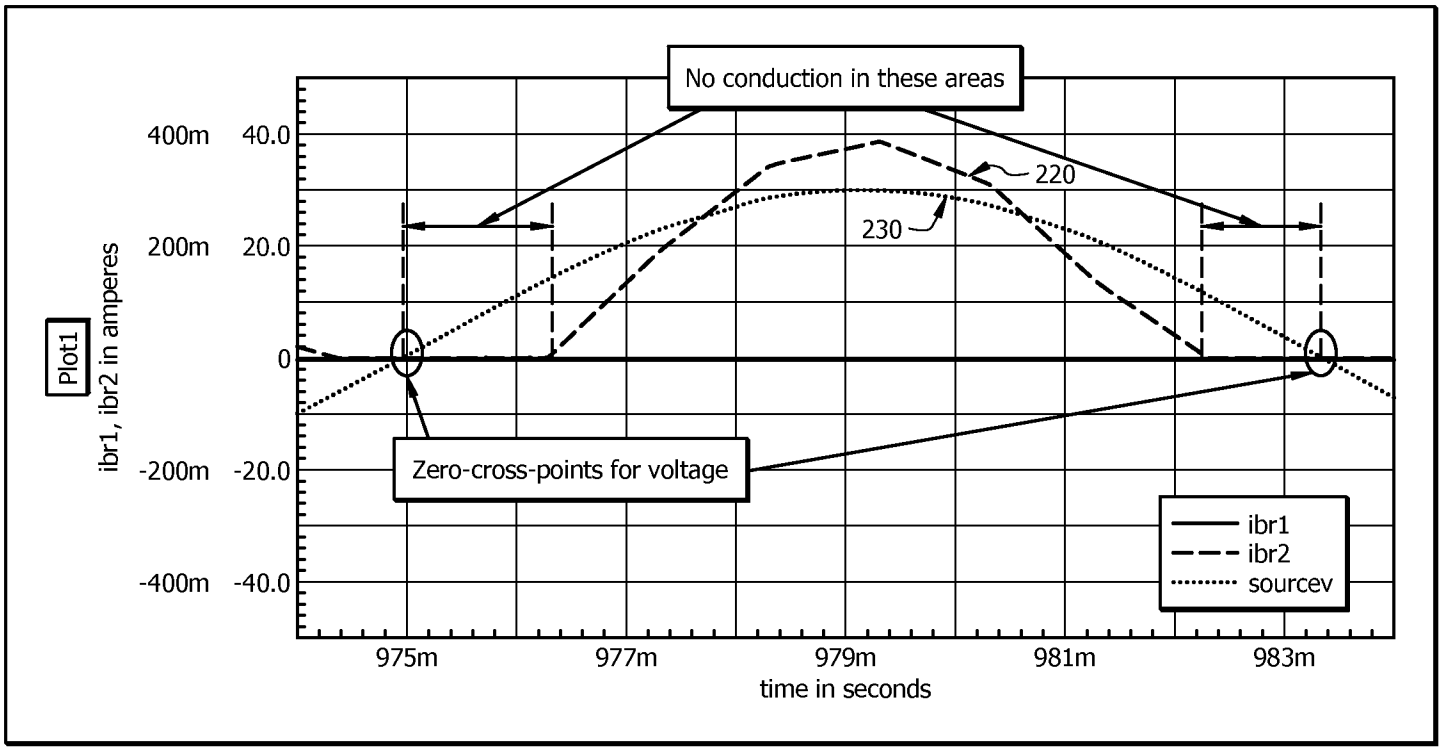
FIG. 2B is a chart of a close up view of the current and voltage waveforms over half an AC cycle from FIG. 2A.

FIG. 2B is a chart of a close up view of the current waveform 220 and voltage waveform 230 over half an AC cycle (shown by a dashed oval circle in FIG. 2A). When the magnitude of a voltage across an LED is between zero and the threshold of conduction (voltage value depends on LED characteristics, e.g., about 0.7 volt), no current may flow through the LED, thus this region is referred to as an "off" or "no conduction" region. Using a 60 Hertz (Hz) AC voltage source, the duration of one off-time (from negative threshold to positive threshold, or vice versa) may last about 3 milli-seconds (mSec). The level of the threshold may be about 1-2 volts on an LED with about 3-4 volts of forward drop at rated currents.

Figure 3:
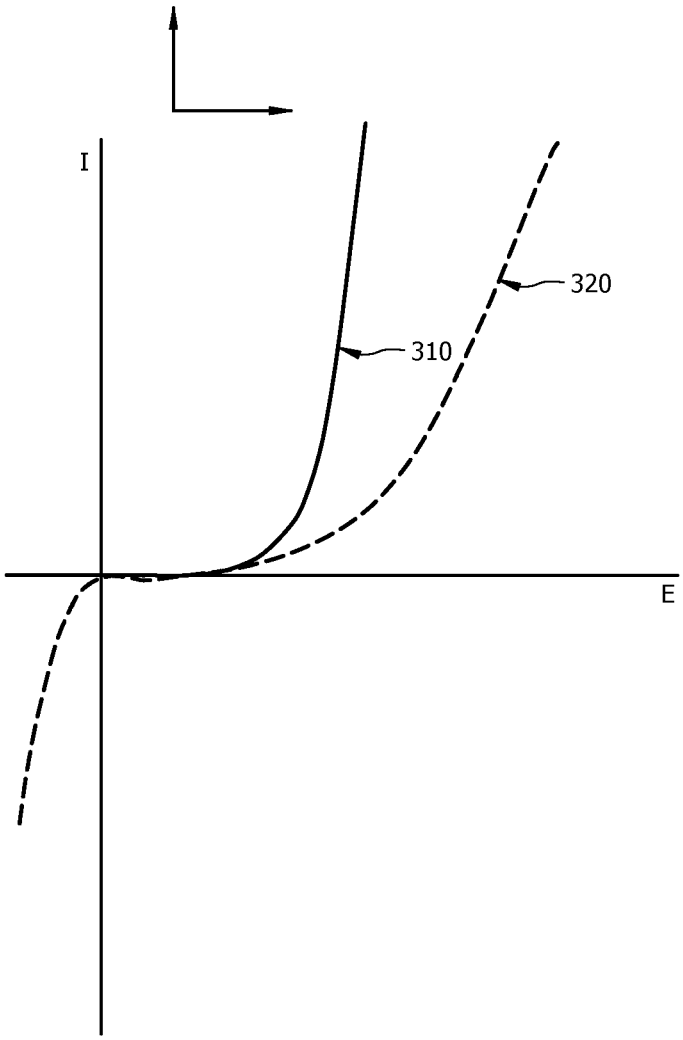
FIG. 3 is a chart of some examplary voltage-current curves for light-emitting diodes (LEDs).

FIG. 3 is a chart of some examplary voltage-current (E-I) curves for LEDs, which may have varying characteristics. For example, depending on the LED brand, a first E-I curve 310 has a "sharp knee" indicating a relatively high slope (di/dv) around the threshold voltage area, and a second E-I curve 320 has a "soft knee" indicating a relatively low slope (di/dv) around the threshold voltage area. A "sharp knee" may lead to a longer dead (no-conduction) time, and a "soft knee" may lead to a shorter dead time.

In use, the dead time may exacerbate a flicker perceived by human eyes, which may render the LED light unsuitable for human viewing. If a 60 Hertz AC line is used, most of the light may be produced within 3 to 5 mSec. Since a half line cycle is 8.3 mSec, the total conduction time may only be about 10%-20% of the half line cycle. After averaging the light output over an line cycle, the light source needs to produce about 3-5 units of light to get about 1 unit of integrated illumination. Further, the strobe effect may become severe, which may render the light source unusable.

The present disclosure may solve the above and other issues in the conventional approach by enabling operation of LEDs directly from the AC voltage mains with reduced off-time and without the need for secondary voltage reduction or control (gear/driver/IC). Removing the intermediate step may reduce cost, increase operational life, and provide high efficiency while producing acceptable regulation. Flicker may be minimized by a passive method of applying a square wave to the LED stack while controlling the current change rate (di/dt) of the circuit. The passive method may be implemented by coupling a capacitor in parallel with each pair of anti-parallel LEDs included in an LED array. The capacitor may store sufficient energy to carry conduction of the conducting LED close to the zero cross of the line voltage to cause snap action of the voltage transition as the conducting LED falls out of conduction, e.g., providing 90% conduction over an AC line cycle. In addition, an inductor may be connected in series with the LED array to regulate an overall current flowing through the LED array. If desired, one or more capacitors may be connected in series with the LED array to provide multiple level operating levels for dimming control.

Figure 4:
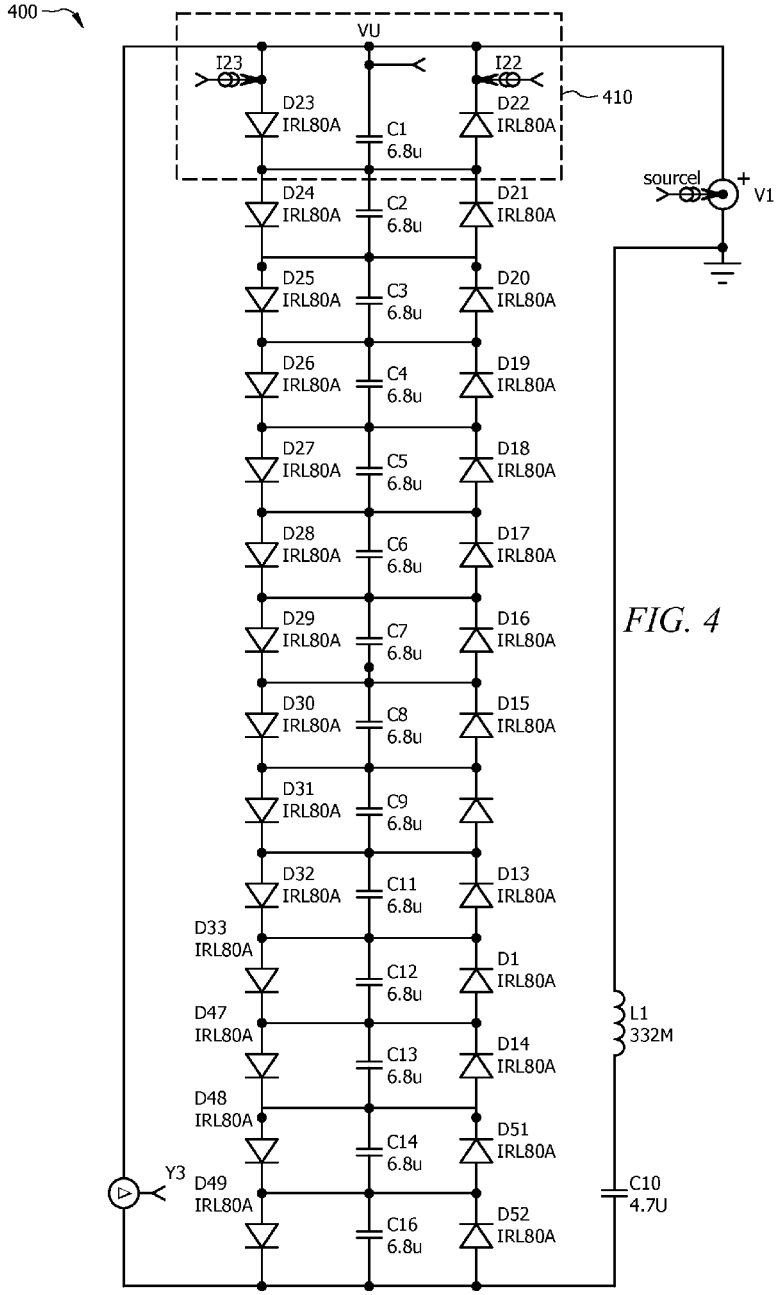
FIG. 4 is a schematic diagram of an embodiment of a circuit.

FIG. 4 is a schematic diagram of an embodiment of a circuit 400, which may serve as an AC light source. An AC source voltage denoted as V1 (e.g. 110 VAC @ 60 HZ) may be coupled or connected to the array of anti-parallel LEDs. Note that the AC voltage may come from the power mains (e.g., 110 VAC @ 60 Hz) or any device that produces an AC output. Each anti-parallel set may comprise a pair of LEDs connected in parallel but with their polarities reversed. Each anti-parallel set is a basic set of the LED array and takes a portion of the AC source voltage. Each anti-parallel set may further comprise a capacitor coupled to the LED pair in parallel. Note that the component values (e.g., capacitance, inductance, and capacitance) shown in FIG. 4 and other drawings merely serve as examplary values, as the components may be designed to have any suitable values.

Take one LED pair 410 as an example, with the assumption that the functioning of other pairs may be similarly understood by one of ordinary skill in the art. An LED denoted as D22 may be connected to another LED denoted as D23 in an anti-parallel configuration, and a capacitor denoted as C1 may be placed between the two ends of both D22 and D23, as shown in FIG. 4. In the pair 410, a voltage across C1 may not have higher magnitude than a forward voltage of either D22 or D23. Accordingly, C1 may be configured to withstand a voltage of about 10 volts or less. In some embodiments, no intervening component may exist between the capacitor and the first group of LEDs or between the capacitor and the second group of LEDs.

In the pair 410, the capacitor C1 may be used for energy storage during conduction. Specifically, a residual voltage retained on the capacitor C1 after a conducting LED (D22 or D23) falls from conduction may shorten a voltage transition time through the zero-cross-point of the mains voltage, thereby creating a snap action that may lead to fast transition of the LEDs. However, it is possible that one or more of the anti-parallel sets may not include any capacitor.

The circuit 400 may further comprise wiring connected to the LED array and configured to directly receive an AC voltage without any AC-DC conversion. The circuit 400 may further comprise an inductor (denoted as L1) connected in series with the LED array. The circuit 400 may further comprise a capacitor (denoted as C10) connected in series with the LED array and the inductor L1. L1 and C10 are further described below.

Figure 5:
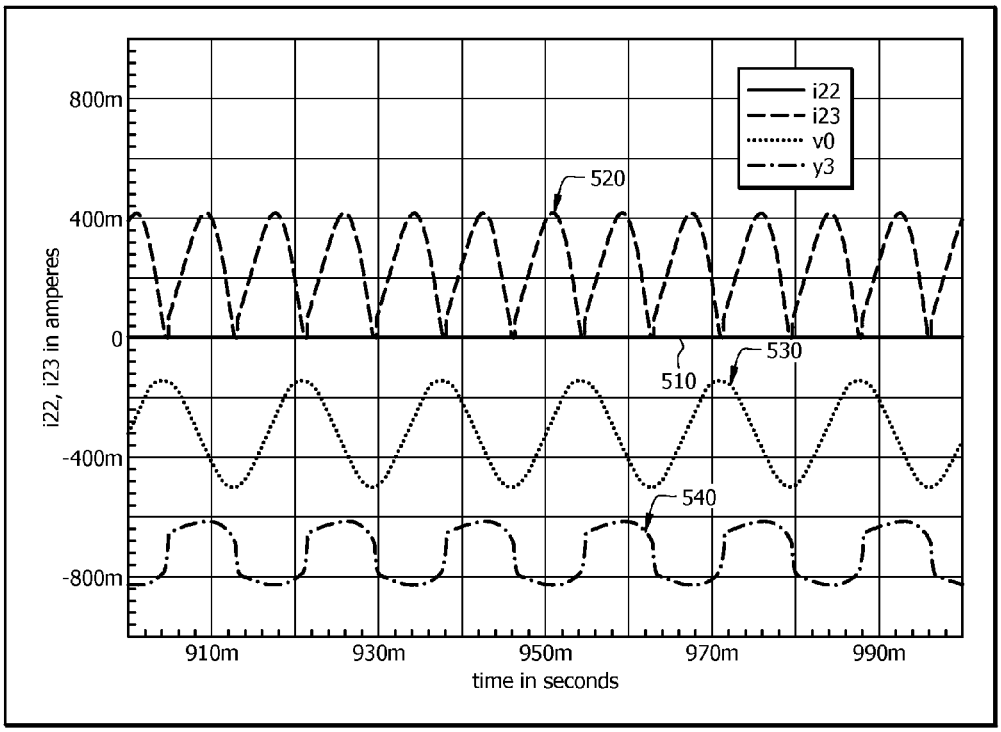
FIG. 5 is a chart of examplary waveforms representing currents and voltages measured at different points in the circuit shown in FIG. 4.

FIG. 5 illustrates examplary waveforms representing currents and voltages measured at different points in the circuit 400. Specifically, a waveform 510 indicates a current (denoted as i22) flowing through the LED D22, a waveform 520 indicates a current (denoted as i23) flowing through the LED D23, a waveform 530 indicates the AC supply voltage (denoted as v0), and a waveform 540 indicates a voltage (denoted as y3) across the whole LED array. The waveforms 510-540 are partially superimposed to show their relative phasing to each other.

Figure 6A:
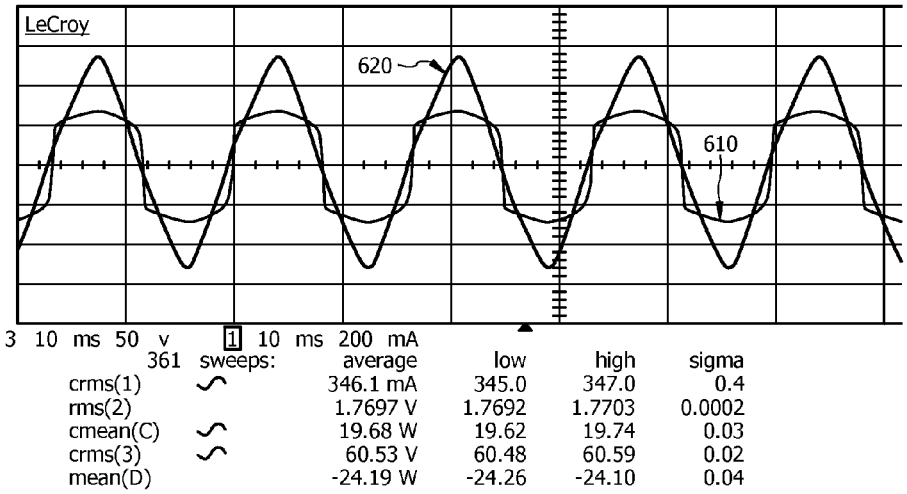
FIG. 6A is a chart of examplary waveforms taken during operation of the circuit shown in FIG. 4.

FIG. 6A further illustrates examplary waveforms taken during operation of a disclosed circuit such as the circuit 400. A first waveform 610 represents a voltage across an anti-parallel LED pair, and a second waveform 620 represents a current flowing through one LED in the pair. As shown in FIG. 6A, the waveform 610 has the appearance of a near-square wave, which indicates that the voltage across the LED pair is substantially a square wave.

Figure 6B:
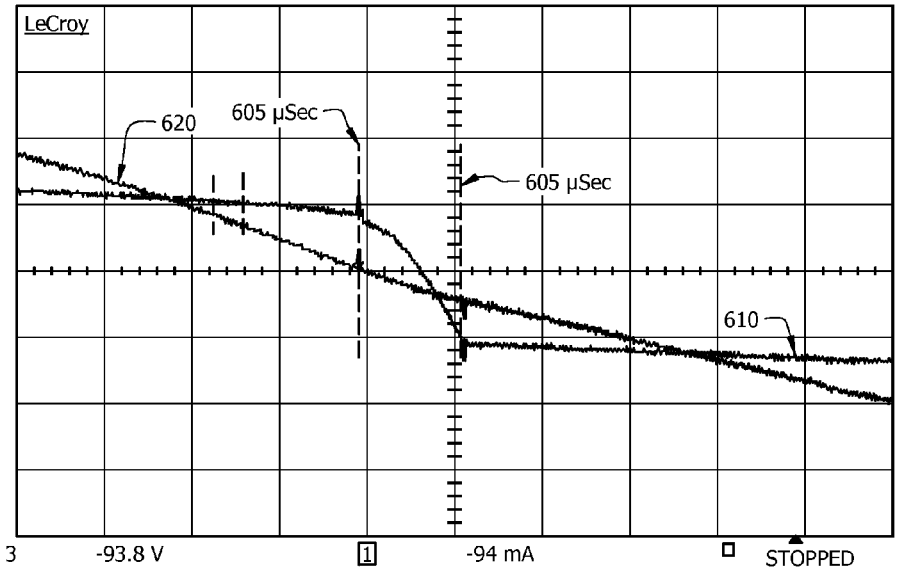
FIG. 6B is a chart of a close up view of waveforms during a voltage transition phase from FIG. 6A.

Note from the waveform 610 that the rising and falling of the voltage across an anti-parallel set is not instant, and there is a period in which neither D22 nor D23 conducts. FIG. 6B illustrates a close up view of the waveforms 610 and 620 during a voltage transition phase. It can be seen that the transition time for the voltage waveform 610 is very small compared to the longer transition time (e.g., shown in FIG. 2B) generated by a conventional AC LED design (e.g., circuit 100). Thus, "substantially square" may still include a small rising/falling edge that indicates a small off-time.

Specifically, when a 60 Hz AC voltage and properly-sized components are used, an off-time in the disclosed circuit may be about 0.6 mSec or 600 micro-seconds (μSec). The off-time is shown as 605 μSec in FIG. 6B, and may vary depending on components used in the circuit. The voltage transitioning effect may be caused by an inductor (denoted as L1 in FIG. 4) that cannot change its current instantaneously. Thus, as the voltage across the anti-parallel LEDs falls below the threshold of conduction, the LEDs may discontinue conduction and force the current to divert through the capacitor, which in turn creates a snap action reset of the capacitor state. As the total period of an AC cycle equals 1 Sec/60 Hz=16.7 mSec, it can be noted that the off-time of the disclosed anti-parallel LEDs is less than 10% (i.e., 2*605 μSec/16.7 mSec=7.2%). The duration of the off-time may depend on factors such as internal impedance of the capacitor. Depending on the applications, a relative off-time may be designed to be less than 1%, 2%, 3%, 4%, 5%, 6%, 7%, 8%, 9%, 10%, 11%, 12%, 13%, 14%, 15%, 16%, 17%, 18%, 19%, 20%, 25%, or any other reasonable percentage.

Figure 7:
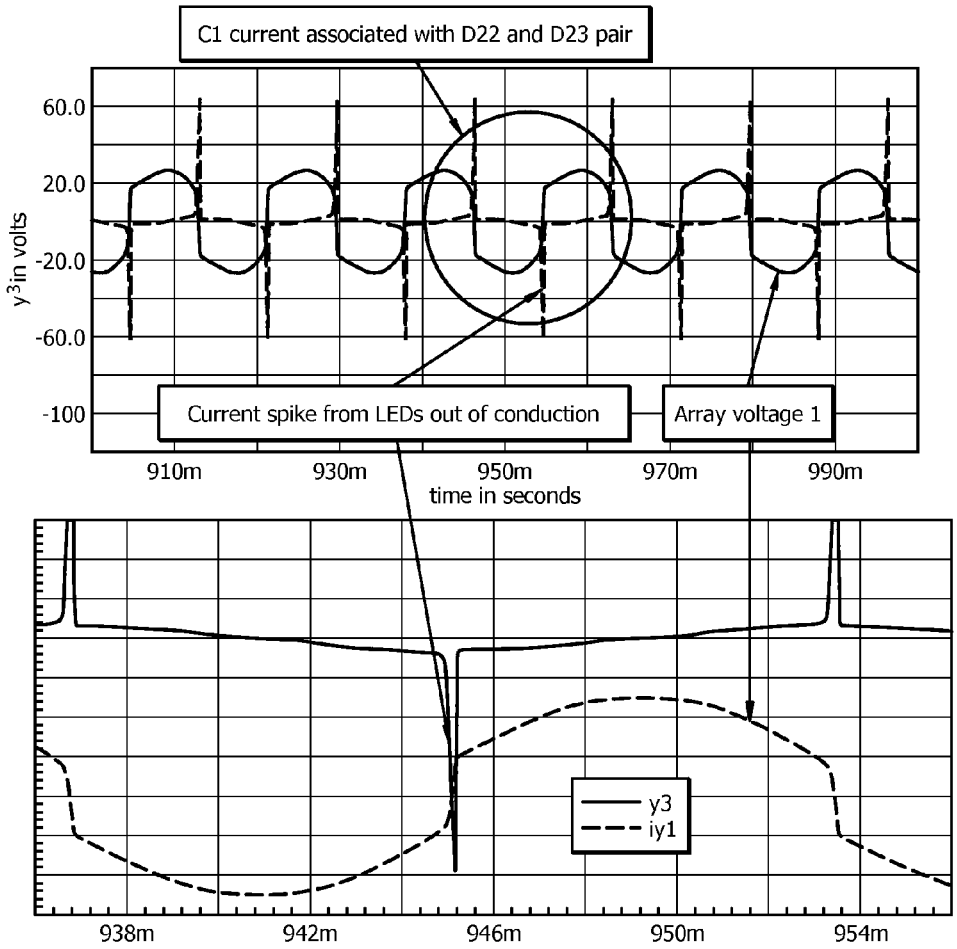
FIG. 7 is a chart of a current flowing through a capacitor in the anti-parallel set during a voltage transition phase.

FIG. 7 further illustrates a current flowing through a capacitor in the anti-parallel set (e.g., C1 connected to the D22 and D33 pair) during a voltage transition phase. As the anti-parallel LED pair comes out of conduction, the current flowing through the inductor L1 cannot change instantaneously. Consequently, the current that was flowing in the LEDs may now be diverted to the capacitor, thereby creating a current "spike" through the capacitor. The capacitor may store sufficient energy to keep the LEDs in conduction for a period, until the last moment before the zero-cross event (AC line voltage crosses zero from negative to positive, or vice versa). In operation, a reduced off-time may help improve minimizing flicker of the LED light. For example, a reduction from about 3 mSec shown in FIG. 2B to about 0.6 mSec in FIG. 6 may lead to a flicker value that is about 30% better. Further, the flicker effect may be softened by using LEDs disclosed herein to excite a phosphor or a phosphorescent material.

As mentioned previously, a pair of anti-parallel connected LEDs may operate under an AC voltage. The AC voltage has a cycle or period that corresponds to an AC frequency. In use, when the AC frequency is in a range that leads to perceivable flicker, e.g., from about 1 to 400 Hz, the pair of anti-parallel LEDs may be configured to alternatively emit lights of different colors or color temperatures, which may to reduce the perceived flicker. In an embodiment, a first LED of the pair may be configured to emit a first-colored light in a first-half cycle, while a second LED of the pair may be configured to emit a second-colored light in a second-half cycle. The first and second-colored lights may have any desired color temperature. For example, the first-colored light may have a color temperature of about 2500 Kelvin (K), while the second-colored light may have a color temperature of about 6000 K. Note that a higher color temperate indicates a shorter light wavelength.

Alternating light colors in two half-cycles of the AC voltage may help reduce a perceived flicker due to chromatic displacement on each half-cycle. This configuration takes advantage of a known chromatic receptor effect, which tells that, when a human eye stares at a bright color shape, and then quickly moves away, the human eye may still see the shape in the background due to fatiguing of particular color receptors in the eye. In a matter of milliseconds, the receptors recover and the lingering shape fades. So there may be a reduction of sensitivity that make flicker seem worse if the same receptors are repeatedly stimulated. According to embodiments disclosed herein, by exciting different chromatic receptors in each half-cycle of the AC voltage, the lesser excited receptors in the eye may be allowed to recover sensitivity, thus making the perceived change in level, during cycle reversal, less noticeable.

Referring back to FIG. 4, a capacitor denoted as C10 may be connected to L1 in series. C10 may be used to adjust the current to various sized strings that may not be close to the optimal number of LEDs for best performance. C10 may not be necessary if the overall voltage needed for the multiple LED sets is substantially similar to the AC voltage. The overall voltage needed for the LED array may depend on the number of anti-parallel sets in the array. Further, the value of C10 may be readily changed to allow for adjustment of the overall current and power levels.

Figure 8:
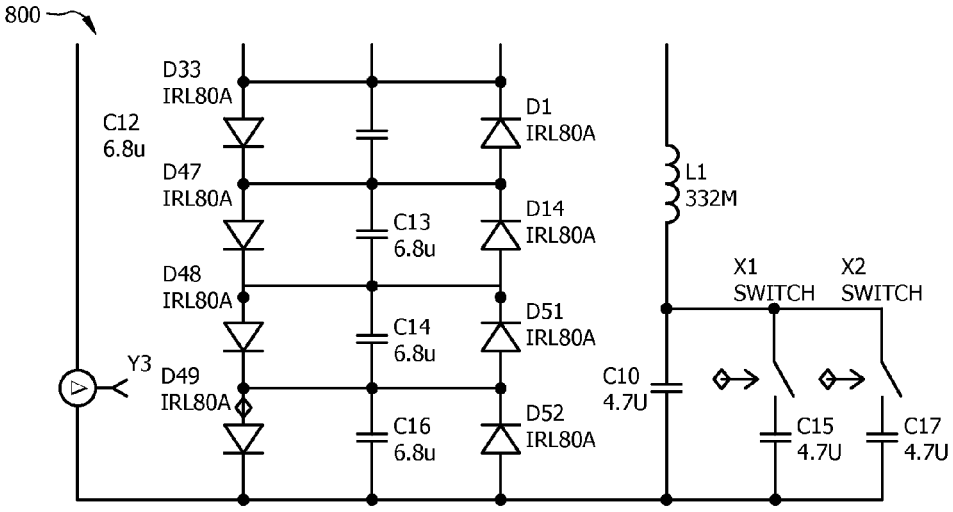
FIG. 8 is a schematic diagram of another embodiment of the circuit.

In practice, the capacitor C10 may be implemented as multiple elements comprising capacitors and switches. FIG. 8 is a schematic diagram of an embodiment of a circuit 800, in which a plurality of capacitors and switches are connected to an inductor in series. For illustrative purposes, three capacitors denoted as C10, C15, C17 and two switches denoted as X1 and X2 are used in the circuit 800. As arranged in FIGS. 8, C15 and C17 may be switched on and off by X1 and X2, respectively, which provides multiple levels of operating voltages for the LED array (that is because a larger capacitor in series with L1 leads to a lower overall voltage of the LED array). The variable overall capacitance may be used as a dimming technique and may be specially effective for high frequency applications.

In some embodiments, a disclosed LED array may be part of a bulb intended to replace a fluorescent tube. For example, components C10 and L1 may be an inherent part of the output circuit of a fluorescent ballast operating with a high frequency quasi-resonant topology. The output may be electronically regulated to be a substantially constant current. In use, any current/voltage regulator (ballast, reactor, etc.) may be used in connection with the LED array, as long as the overall current flowing through the LED array and the voltage across the LED array may be kept relatively stable (e.g., variation within ±15%).

The light source circuit may or may not include C10, and likewise may or may not include the inductor L1. For example, a simplest configuration of output circuitry includes no C10 or L1. The disclosed array of anti-parallel LEDs with parallel capacitors may be connected directly to the AC source voltage, or to the output of a fluorescent ballast (e.g., a commercialized ballast). In other words, the disclosed LED array may be made into a panel or a tube (any shape is possible) as a replacement of a commercial fluorescent tube, and work in conjunction with a conventional ballast. Compared with a fluorescent tube, an LED tube may have higher power efficiency, more light output, and/or longer life.

In some embodiments, a small inductor may be included for other purposes such as prevention of electromagnetic interference (EMI) and/or radio frequency interference (RFI). Note that a ballast disclosed herein may not necessarily have a quasi-resonant topology; instead, the ballast may be a simple reactor-style ballast or have any other topology that includes a capacitor in series with an inductor. Further, if desired, one or more taps or switches may be used to fractionalize the inductance of the current-regulating inductor L1. Any bilateral means of tapping or switching may be used in the inductor to adjust the current or power.

It should be understood that the number of anti-parallel sets or steps is not limited to what is shown herein and in fact may be any suitable number. Although the schematic diagrams show switches as mechanical ones, a switch described herein may be implemented as any suitable AC switching device including, but not limited to, triac, relays, and bilateral switches.

Figure 9:
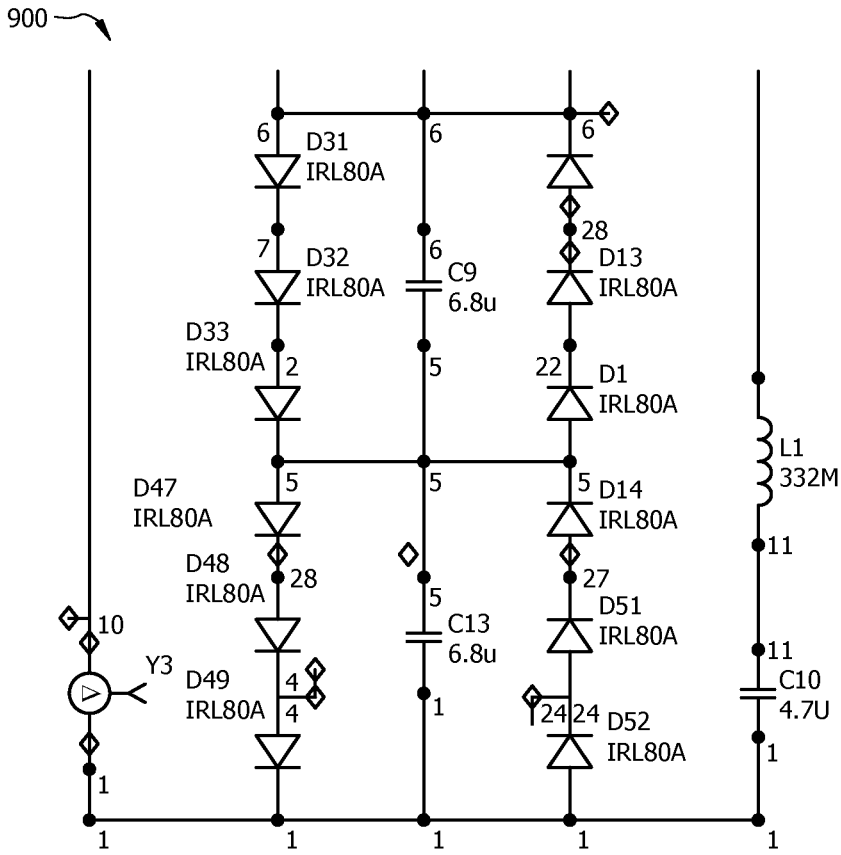
FIG. 9 is a schematic diagram of yet another embodiment of the circuit.

FIG. 9 is a schematic diagram of an embodiment of a circuit 900, in which each branch of anti-parallel set comprises a plurality of LEDs. For example, LEDs denoted as D14, D51, D52 may be connected in series on one branch as a one-dimensional string, while LEDs denoted as D47, D48, D49 may be connected in series on the other mating branch as another one-dimensional string. In this case, D14, D51, D52 may be considered a first group of LEDs, and the D47, D48, D49 may be considered a second group of LEDs. According to descriptions above, it is possible that one group of LEDs on an anti-parallel branch includes one LED (as shown in the circuit 400). The two branches may be connected in parallel, and be further connected in parallel with a capacitor denoted as C13. Note that each branch may comprise any suitable number of LEDs connected back-to-back, and the capacitor may have any suitable capacitance. Further, in an LED array comprising multiple anti-parallel sets, any two of the sets may or may not have an equal number of LEDs, and the capacitance in each set may be configured based on the characteristics of its coupled LEDs. Although each anti-parallel set is shown to have only one capacitor, it is not so limited. Moreover, it is possible that one or more of the anti-parallel sets may not include any capacitor.

In use, each LED in the anti-parallel set raises the voltage C13 needs to withstand. During the voltage transition period (including the zero voltage cross point), in order to speed voltage transition and/or reduce off-time of the anti-parallel LEDs, C13 can be sized to sustain the forward conducting current for both anti-parallel branches (one comprising D14, D51, D52, and the other comprising D47, D48, D49).

Although a frequency of 60 Hz is used as an examplary operating frequency, the disclosed circuit may operate at any suitable AC frequency, which may be lower than 60 Hz or much higher than 60 Hz (e.g., a few hundred thousand Hz). The operating frequency may be limited only by the high frequency response/recovery times of LEDs.

With any of the switching scenarios, dampening components may be included to protect an LED array from either transient energy generated therein or from a voltage source. These components can include transient suppression either active or passive.

An LED array or a light source circuit disclosed herein may be packaged or housed in a package in any suitable fashion, e.g., as a single die or stacked dies in an anti-parallel arrangement. The light source may be an assembly of an LED array, a capacitor and an inductor connected in series with the LED array, and a package. The assembly may be implemented as a single die, or as multiple dies. Also, an LED may be defined as a package designed to host or support one or more dies. Further, multiple dies may be connected in series or parallel having the same orientation or polarity. Alternatively, there may be a first group of dies connected in series/parallel with same orientation, and a second group of dies connected in series/parallel with the opposite orientation. The package may encompass at least the LED array and may be translucent or transparent for light transmittance. The package may be made of plastic, glass, or any other suitable material(s) and may include metal electrical connectors such as wiring to receive an AC voltage.

In an embodiment, a light source disclosed herein may consist essentially of a first string of LEDs, a second string of LEDs connected in anti-parallel with the first string of LEDs, one or more capacitors connected in parallel with the first string of LEDs and the second string of LEDs, an optional inductor connected in series with the first string of LEDs and the second string of LEDs, an optional capacitor connected in series with the inductor, the first string of LEDs, and the second string of LEDs, and a package that encompasses at least the first string of LEDs and the second string of LEDs. As discussed above, the optional inductor and optional capacitor may be removed if desired (e.g., the assembly can work with a fluorescent ballast).

In another embodiment, a light source disclosed herein may consist of a first string of LEDs, a second string of LEDs connected in anti-parallel with the first string of LEDs, one or more capacitors connected in parallel with the first string of LEDs and the second string of LEDs, and a package that encompasses at least the first string of LEDs and the second string of LEDs.

In yet another embodiment, a light source disclosed herein may consist of a first string of LEDs, a second string of LEDs connected in anti-parallel with the first string of LEDs, one or more capacitors connected in parallel with the first string of LEDs and the second string of LEDs, an inductor connected in series with the first string of LEDs and the second string of LEDs, and a package that encompasses at least the first string of LEDs and the second string of LEDs.

In yet another embodiment, a light source disclosed herein may consist of a first string of LEDs, a second string of LEDs connected in anti-parallel with the first string of LEDs, one or more capacitors connected in parallel with the first string of LEDs and the second string of LEDs, an inductor connected in series with the first string of LEDs and the second string of LEDs, a capacitor connected in series with the inductor, the first string of LEDs, and the second string of LEDs, and a package that encompasses at least the first string of LEDs and the second string of LEDs.

An LED, a capacitor, an inductor, a resistor described herein may be of any suitable type. Note that a capacitor, inductor, resistor may not be limited to its literal meaning. For example, a capacitor may be implemented as a group of capacitors connected in any fashion to create an overall capacitance equivalent of the capacitor.

Figure 10:
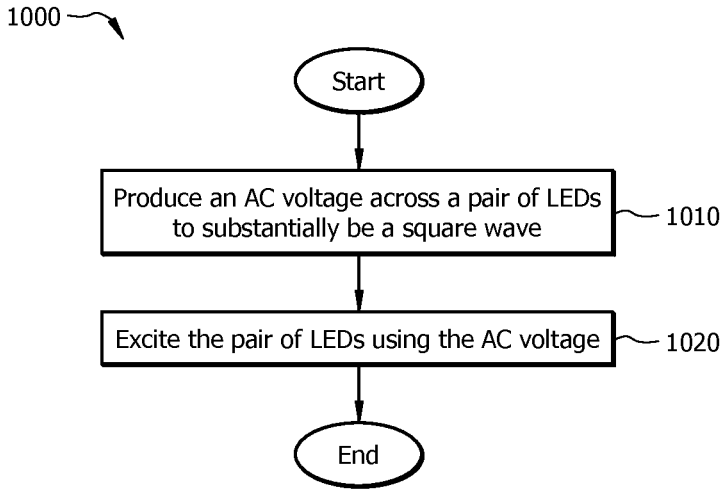
FIG. 10 is a flowchart of an embodiment of a method for controlling an LED-based light source.

FIG. 10 is a flowchart of an embodiment of a method 1000 for controlling an LED-based light source, which may operate under an AC voltage source and comprise an LED array with at least one pair of anti-parallel connected LEDs. The method 1000 may be implemented using any embodiment of circuits disclosed herein (e.g., the circuit 400, 800, or 900). The method 1000 starts in step 1010, in which an AC voltage across a pair of LEDs may be produced to substantially be a square wave. In an embodiment, producing the AC voltage comprises using a capacitor connected in parallel with the pair of LEDs to create a snap action near a zero-cross event of the AC voltage source. Further, the square wave shape of the AC voltage may cause the pair of LEDs to have a relative off-time of less than 10%, 15%, or any other reasonable percentage, wherein a magnitude of the AC voltage remains smaller than a threshold voltage of the pair of LEDs during the off-time.

In step 1020, the pair of LEDs may be excited using the produced AC voltage. It should be understood that the method 1000 includes only a portion of necessary steps in controlling an LED-based light source, thus other steps may be added in any suitable fashion.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. The use of the term "about" means+/−10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A circuit serving as a light source, the circuit comprising:
a first set of light-emitting diodes (LEDs); and
a second set of LEDs that is connected in series to the first set of LEDs,
wherein the first set of LEDs comprises:
a first group of LEDs;
a second group of LEDs connected in anti-parallel with the first group of LEDs, wherein each of the first group of LEDs and the second group of LEDs comprises at least one LED; and
a first capacitor connected in parallel with the first group of LEDs and the second group of LEDs, and
wherein the second set of LEDs comprises:
a third group of LEDs;
a fourth group of LEDs connected in anti-parallel with the third group of LEDs, wherein each of the third group of LEDs and the fourth group of LEDs comprises at least one LED; and
a second capacitor connected in parallel with the third group of LEDs and the fourth group of LEDs.

2. The circuit of claim 1, wherein each of the first group of LEDs, the second group of LEDs, the third group of LEDs, and the fourth group of LEDs comprises a plurality of LEDs.

3. The circuit of claim 2, wherein no intervening components exist between the first capacitor and the first group of LEDs, wherein no intervening components exist between the first capacitor and the second group of LEDs, wherein no intervening components exist between the second capacitor and the third group of LEDs, and wherein no intervening components exist between the second capacitor and the fourth group of LEDs.

4. The circuit of claim 1, further comprising an inductor connected in series with the first set of LEDs and the second set of LEDs, and wherein the inductor is configured to regulate an overall current flowing through the first set of LEDs and the second set of LEDs.

5. The circuit of claim 4, wherein the inductor comprises a plurality of taps for fractioning an inductance of the inductor.

6. The circuit of claim 4, further comprising an additional capacitor connected in series with the inductor, the first set of LEDs, and the second set of LEDs.

7. A circuit serving as a light source, the circuit comprising:
a first group of light-emitting diodes (LEDs);
a second group of LEDs connected in anti-parallel with the first group of LEDs, wherein each of the first group of LEDs and the second group of LEDs comprises at least one LED;
a capacitor connected in parallel with the first group of LEDs and the second group of LEDs;
an inductor connected in series with the first group of LEDs and the second group of LEDs, wherein the inductor is configured to regulate an overall current flowing through an anti-parallel set composed of the first group of LEDs, the second group of LEDs, and the capacitor;

an additional capacitor connected in series with the first group of LEDs and the second group of LEDs and in series with the inductor; and a switch and at least one capacitor connected in series with the switch, wherein the combination of the switch and the at least one capacitor is connected in parallel with the additional capacitor.

8. The circuit of claim 1, further comprising wiring configured to receive an alternating current (AC) voltage and connected to the first set of LEDs without any intervening AC to direct current (DC) conversion.

9. The circuit of claim 8, wherein the first capacitor and the second capacitor are configured to create a snap action during a transition phase of the AC voltage source such that a voltage across the first set of LEDs and the second set of LEDs has substantially the shape of a square wave.

10. A circuit serving as a light source, the circuit comprising:

a first group of light-emitting diodes (LEDs);

a second group of LEDs connected in anti-parallel with the first group of LEDs, wherein each of the first group of LEDs and the second group of LEDs comprises at least one LED;

a capacitor connected in parallel with the first group of LEDs and the second group of LEDs; and wiring configured to receive an alternating current (AC) voltage and connected to the first group of LEDs without an intervening AC to direct current (DC) conversion, wherein the capacitor is configured to create a snap action during a transition phase of the AC voltage source such that a voltage across the first group of LEDs has substantially the shape of a square wave, wherein the transition phase occurs when the AC voltage source crosses a zero point, and wherein the square wave of the voltage across the first group of LEDs causes the first group of LEDs and the second group of LEDs to have a relative off-time of less than 15%.

11. A method for controlling a light-emitting diode (LED)-based light source that operates under an alternating current (AC) source and comprises at least one pair of anti-parallel connected LEDs, the method comprising:

producing an AC voltage across a pair of LEDs to substantially be a square wave shape; and exciting the pair of LEDs using the AC voltage, wherein producing the AC voltage comprises using a capacitor connected in parallel with the pair of LEDs to create a snap action near a zero-cross event of the AC source, wherein the square wave shape of the AC voltage causes the pair of LEDs to have a relative off-time of less than 10%, and wherein a magnitude of the AC voltage remains smaller than a threshold voltage of the pair of LEDs during the off-time.

12. The circuit of claim 1, further comprising multiple additional sets of LEDs, wherein each one of the multiple additional sets of LEDs comprises a capacitor connected in parallel with a group of anti-parallel LEDs, and wherein the first set of LEDs, the second set of LEDs, and the multiple additional sets of LEDs are connected in series.

13. The circuit of claim 12, wherein each of the first set of LEDs, the second set of LEDs, and the multiple additional sets of LEDs comprises only two LEDs.

14. The circuit of claim 12, wherein each of the first set of LEDs, the second set of LEDs, and the multiple additional sets of LEDs comprises more than two LEDs.

15. The circuit of claim 12, further comprising wiring that is connected in series with the first set of LEDs, the second set of LEDs, and the multiple additional sets of LEDs and that is configured to apply an alternating current (AC) voltage across the first set of LEDs, the second set of LEDs, and the multiple additional sets of LEDs.

16. The circuit of claim 15, wherein the wiring comprises an inductor and an additional capacitor connected in series with the first set of LEDs, the second set of LEDs, and the multiple additional sets of LEDs.

17. The circuit of claim 16, wherein the additional capacitor comprises multiple capacitors connected in parallel to each other.

18. The circuit of claim 12, wherein each of the first set of LEDs, the second set of LEDs, and the multiple additional sets of LEDs comprises an LED that is configured to emit light having a color temperature of about 2,500 Kelvin (K) and an LED that is configured to emit light having a color temperature of about 6,000 K.

* * * * *

UNITED STATES PATENT AND TRADEMARK OFFICE

CERTIFICATE OF CORRECTION

PATENT NO. : 8,841,856 B1
APPLICATION NO. : 14/045581
DATED : September 23, 2014
INVENTOR(S) : Denny D. Beasley It is certified that error appears in the above-identified patent and that said Letters Patent is hereby corrected as shown below:

In the claims:

Column 11, lines 12-16, claim 9, should read as:
--9. The circuit of claim 8, wherein the first capacitor and the second capacitor are configured to create a snap action during a transition phase of an AC voltage source such that a voltage across the first set of LEDs and the second set first of LEDs has substantially the shape of a square wave.--

Column 11, lines 17-38, claim 10, should read as:
--10. A circuit serving as a light source, the circuit comprising:

a first group of light-emitting diodes (LEDs);

a second group of LEDs connected in anti-parallel with the first group of LEDs, wherein each of the first group of LEDs and the second group of LEDs comprises at least one LED;

a capacitor connected in parallel with the first group of LEDs and the second group of LEDs; and wiring configured to receive an alternating current (AC) voltage and connected to the first group of LEDs without any intervening AC to direct current (DC) conversion, wherein the capacitor is configured to create a snap action during a transition phase of an AC voltage source such that a voltage across the first group of LEDs has substantially the shape of a square wave, wherein the transition phase occurs when the AC voltage source crosses a zero point, and wherein the square wave of the voltage across the first group of LEDs causes the first group of LEDs and the second group of LEDs to have a relative off-time of less than 15%.--

Signed and Sealed this
Twenty-seventh Day of January, 2015

Michelle K. Lee

Michelle K. Lee
*Deputy Director of the United States Patent and Trademark Office*